US010159626B2

(12) United States Patent
Nishioka et al.

(10) Patent No.: US 10,159,626 B2
(45) Date of Patent: Dec. 25, 2018

(54) LID COVER FOR MEDICINE CONTAINER

(71) Applicant: OTSUKA PHARMACEUTICAL FACTORY, INC., Naruto-shi, Tokushima (JP)

(72) Inventors: Masaki Nishioka, Naka-gun (JP); Osamu Takiguchi, Naka-gun (JP); Katsuyoshi Hamai, Naka-gun (JP); Tetsuya Masuda, Naka-gun (JP); Fujio Inoue, Naruto (JP); Koichi Takeda, Naruto (JP)

(73) Assignee: OTSUKA PHARMACEUTICAL FACTORY, INC., Naruto-Shi (JP)

( * ) Notice: Subject to any disclaimer, the term of this patent is extended or adjusted under 35 U.S.C. 154(b) by 0 days.

(21) Appl. No.: 15/569,917

(22) PCT Filed: Mar. 4, 2016

(86) PCT No.: PCT/JP2016/056839
§ 371 (c)(1),
(2) Date: Oct. 27, 2017

(87) PCT Pub. No.: WO2016/174925
PCT Pub. Date: Nov. 3, 2016

(65) Prior Publication Data

US 2018/0147115 A1 May 31, 2018

(30) Foreign Application Priority Data

Apr. 30, 2015 (JP) ..... 2015-092898

(51) Int. Cl.
*A61J 1/05* (2006.01)
*A61J 1/14* (2006.01)
(Continued)

(52) U.S. Cl.
CPC ..... *A61J 1/1406* (2013.01); *A61J 1/1425* (2015.05); *A61J 1/2096* (2013.01); *B65D 51/18* (2013.01)

(58) Field of Classification Search
CPC ..... A61J 1/1406; A61J 1/1412; A61J 1/1418; A61J 1/1425; A61J 1/1431; A61J 1/1437;
(Continued)

(56) References Cited

U.S. PATENT DOCUMENTS 2,891,689 A 6/1959 Gould
4,582,207 A 4/1986 Howard et al.
(Continued)

FOREIGN PATENT DOCUMENTS

DE 102008053299 A1 4/2010
EP 0161797 A2 11/1985
(Continued)

OTHER PUBLICATIONS

Chinese Office Action issued in corresponding Chinese Application No. 201680024981.0 and dated Apr. 8, 2018.
(Continued)

*Primary Examiner* — Philip R Wiest
(74) *Attorney, Agent, or Firm* — Birch, Stewart, Kolasch & Birch, LLP

(57) ABSTRACT

The present invention provides a lid cover (1) of a medicine container (2) for preventing a medicine, which is air-tightly stored in a medicine container (2) that has a lid portion (22) that can be pierced with a needle (33), from leaking to an outside space when the medicine is suctioned using a syringe (3) having the needle (33), the lid cover (1) including a peripheral wall portion (10) that can be mounted to the lid portion (22) so as to surround a piercing face of the lid portion (22) that is pierced with the needle (33) and a ceiling face portion (50) that is continuous with an upper portion of
(Continued)

the peripheral wall portion (10), and can be pierced with the needle (33), wherein the peripheral wall portion (10) and the ceiling face portion (50) are made of an elastic material, and are configured to air-tightly store the piercing face such that the piercing face is not exposed to the outside space in a state where the peripheral wall portion (10) is mounted to the lid portion (22), while also forming a closed space between the piercing face and the ceiling face portion (50), and the ceiling face portion (50) has a central portion (51) that opposes the piercing face, and is pierced with the needle, and an outer periphery portion (52) that is formed in the periphery of the central portion (51), and is thinner than the central portion (51).

13 Claims, 13 Drawing Sheets

(51) Int. Cl.
*B65D 51/18* (2006.01)
*A61J 1/20* (2006.01)

(58) Field of Classification Search
CPC ..... A61J 1/1443; A61J 1/145; A61J 1/2096; B65D 51/18
USPC ..... 604/403–416
See application file for complete search history.

(56) References Cited

U.S. PATENT DOCUMENTS 4,619,651 A * 10/1986 Kopfer ..... A61J 1/2096 604/414
4,815,619 A 3/1989 Turner et al.
2006/0253103 A1 11/2006 Utterberg et al.
2012/0136333 A1 5/2012 Hatalla
2013/0085466 A1 4/2013 Ishiwata et al.
2015/0112296 A1* 4/2015 Ishiwata ..... A61J 1/1406 604/406

FOREIGN PATENT DOCUMENTS

| | | | |
|---|---|---|---|
| EP | 2856999 | A1 | 4/2015 |
| GB | 1284095 | A | 8/1972 |
| JP | 61-228865 | A | 10/1986 |
| JP | 62-160940 | U | 10/1987 |
| JP | 2014-161473 | A | 9/2014 |
| KR | 20-0135169 | Y1 | 3/1999 |
| RU | 2482040 | C2 | 5/2013 |
| WO | WO 2010/113823 | A1 | 10/2010 |
| WO | WO 2013/179596 | A1 | 12/2013 |
| WO | WO 2014/104027 | A1 | 7/2014 |

OTHER PUBLICATIONS

Korean Office Action for Korean Application No. 10-2017-7031370, dated Mar. 8, 2018, with English translation.
Russian Office Action and Search Report, dated Jun. 8, 2018, for Russian Application No. 2017141559, with English translation of the Russian Office Action.
Korean Office Action, dated Dec. 15, 2017, for corresponding Korean Application No. 10-2017-7031370, with English translation.
International Search Report, issued in PCT/JP2016/056839, PCT/ISA/210, dated May 17, 2016.
Written Opinion of the International Searching Authority, issued in PCT/JP2016/056839, PCT/ISA/237, dated May 17, 2016.
Extended European Search Report dated Mar. 9, 2018 for European Application No. 16786202.8.
Office Action issued in Chinese Application No. 201680024981.0 dated Sep. 10, 2018.

* cited by examiner

LID COVER FOR MEDICINE CONTAINER

TECHNICAL FIELD

The present invention relates to a lid cover for a medicine container, a storage body of a lid cover, a storage implement for the lid cover, and a method for mounting the lid cover.

BACKGROUND ART

Conventionally, damage to the health of medical professionals who handle a cytotoxic medicine used in cancer chemotherapy and the like is regarded as a problem. The reason for this is as follows: cytotoxic medicines are usually distributed in a state of being sealed in a medicine container, but medical professionals need to pierce a lid portion of such a container with a needle set in a syringe, and dissolve, dilute, mix, and extract the medicine within the container, and during such operations, there are many cases in which the medicine leaks and volatilizes via a needle hole formed by piercing the lid portion of the medicine container with the needle of the syringe, thus exposing medical professionals to the medicine.

In order to solve the above problem, Patent Literature 1 and Patent Literature 2 disclose a lid cover that is mounted to a lid portion of a medicine container so as to cover the lid portion when extracting a medicine. The lid cover of Patent Literature 1 is configured to secure a certain closed space between the ceiling face portion of the lid cover that is pierced with a needle of a syringe and the lid portion of the medicine container. As a result, even if a medicine leaks via a needle hole formed in the lid portion of the medicine container, the leaked medicine is contained in the closed space, and leakage to the outside space is suppressed.

On the other hand, Patent Literature 2 discloses a lid cover provided with a cap-shaped housing that is mounted to a mouth portion of a medicine container. The housing of the lid cover is formed of hard plastic, and a piercing hole is formed in the central portion of the housing. Also, the lid cover is characterized in having a rubber sheet that blocks the piercing hole, and in that the rubber sheet has a protruding shape protruding toward the rubber plug side of the medicine container. Furthermore, in the disclosure, it is preferable that the internal space between the mouth portion of the medicine container and the lid cover is in communication with the outside via a filter member. This is for resolving the generation of positive pressure in the internal space due to the occurrence of pressure difference between the outside and the inside of a syringe when the needle of the syringe is pulled out from the rubber sheet. Accordingly, when positive pressure is generated in the internal space, there is a risk that the medicine leaks, but positive pressure generated in the internal space is resolved by providing the filter member that is in communication with the outside.

CITATION LIST

Patent Literature

Patent Literature 1: JP S61-228865A
Patent Literature 2: WO 2013/179596

SUMMARY OF INVENTION

Technical Problem

However, even if the lid cover of Patent Literature 1 is used, leakage of a medicine can still occur. Specifically, according to the lid cover of Patent Literature 1, a medicine that leaked out into the closed space can be contained, but at this time, positive pressure is generated in the closed space due to the leaked medicine. Therefore, the medicine contained in the closed space frequently leaks out from the closed space further to the outside space via a needle hole formed in the lid cover. Note that the case where a cytotoxic medicine is handled has been described above, but the present invention is not limited thereto, and a similar problem can occur also when handling other medicines such as odorous and irritative medicines and the like that can cause a problem when exposed to the outside.

Meanwhile, the lid cover of Patent Literature 2 also has the following problem. For example, if the medicine is highly volatile, there is a risk that the medicine that has vaporized leaks to the outside through the filter. In addition, the housing is made of hard plastic, and thus there is a risk that a gap is formed between the housing and the lid cover depending on the size of the mouth portion of the medicine container.

An object of the present invention is to provide a storage body of a lid cover for a medicine container that, even if a medicine leaks from the medicine container via a needle hole formed by piercing a lid portion of the medicine container with a needle of a syringe, can prevent the medicine from being exposed to the outside space, as well as a storage implement for the lid cover, and a method for mounting the lid cover.

Solution to Problem

A first lid cover for a medicine container according to the present invention is a lid cover for a medicine container for preventing a medicine, which is air-tightly stored in the medicine container having a lid portion that can be pierced with a needle, from leaking to an outside space when the medicine is suctioned using a syringe having the needle, the lid cover including: a peripheral wall portion that can be mounted to the lid portion so as to surround a piercing face in the lid portion that is pierced with the needle; and a ceiling face portion that is continuous with an upper portion of the peripheral wall portion, and can be pierced with the needle, wherein the peripheral wall portion and the ceiling face portion are made of an elastic material, and are configured to, in a state where the peripheral wall portion is mounted to the lid portion, air-tightly store the piercing face such that the piercing face is not exposed to the outside space, while also forming a closed space between the piercing face and the ceiling face portion, and the ceiling face portion has a central portion that opposes the piercing face, and is pierced with the needle, and an outer periphery portion that is formed in a periphery of the central portion, and is thinner than the central portion.

According to this configuration, when suctioning a medicine in the medicine container using the syringe, the piercing face of the lid portion of the medicine container that is pierced with the needle of the syringe is air-tightly stored using the lid cover so as not to be exposed to the outside space. Furthermore, the piercing face is air-tightly stored under the lid cover, and the closed space is formed between the ceiling face portion of the lid cover and the piercing face. Therefore, after the medicine is suctioned, and the needle of the syringe is removed from the lid portion of the medicine container, even if the medicine leaks out from inside of the medicine container via a needle hole formed in the lid portion of the medicine container, the leaked medicine is contained in the closed space.

In addition, this ceiling face portion of the lid cover includes a central portion that opposes the piercing face, and that is pierced with the needle, and an outer periphery portion that is formed in a periphery of the central portion, and that is thinner than the central portion, and thus the airtightness of the needle hole formed in the central portion by the needle of the syringe can be maintained high. The following is considered to be a reason for this. Specifically, when the lid cover is mounted to the lid portion of the medicine container, the peripheral wall portion is pressed and widened by the lid portion, and accordingly a force that spreads outward in the radial direction is applied to the ceiling face portion of the lid cover. Accordingly, a force is applied to the ceiling face portion such that a needle hole that is a gap between the needle and the ceiling face portion that is being pierced with the needle or a needle hole after the needle is pulled out expands. Meanwhile, in the present invention, the thin outer periphery portion is formed in the periphery of the central portion that is pierced with the needle, and thus a force applied outward in the radial direction is mainly applied to the outer periphery portion that is thin and is likely to elastically deform, and does not reach the central portion. As a result, the above-described needle hole is prevented from being widened, and the airtightness of the needle hole of the ceiling face portion can be maintained high. Therefore, even if a medicine leaks from inside of the medicine container to the closed space via the needle hole formed in the lid portion of the medicine container by being pierced with the needle of the syringe, it is possible to prevent exposure to the outside space. Furthermore, the airtightness of the needle hole is high, and thus when removing the needle, the medicine adhering to the needle tip is substantially completely wiped off. Therefore, also in this regard, it is possible to improve the exposure prevention effect.

The above-described lid cover can further include: a restriction member that restricts contact of the lid portion with the ceiling face portion in order to form the closed space between the lid portion and the ceiling face portion.

According to this configuration, the restriction member is configured to prevent the lid portion of the medicine container from coming into contact with the ceiling face portion regardless of the method for mounting the lid cover to the medicine container, and thus the closed space can be reliably formed between the lid portion and the ceiling face portion. This configuration of the restriction member is not particularly limited, but the restriction member can be formed by a plurality of ribs that protrude from the lower face of the ceiling face portion or the inner periphery face of the peripheral wall portion, for example. The shape of such ribs is a columnar shape, a flat plate shape or the like, and is not particularly limited, but a flat plate shape that is continuous with the inner face of the peripheral wall portion is preferable to form the closed space in a stable manner. Also, three to eight ribs are preferably provided in the peripheral direction of the peripheral wall portion at a predetermined interval (for example, substantially equal intervals) in order to stabilize a mounted state.

In the above-described lid cover, an upper face of the ceiling face portion can be formed in a flat face shape or a curved face shape. Also, the central portion can be formed so as to protrude from a lower face of the ceiling face portion. In this case, in the lower face of the ceiling face portion, a portion that does not protrude toward the piercing face becomes the thin outer periphery portion. Accordingly, the thick central portion can be formed without providing a protrusion in the upper face of the ceiling face portion.

In addition, in any one of the above-described lid covers, for example, a ratio of a thickness of the central portion to a thickness of the outer periphery portion can be 2 to 10 in order to concentrate, on the outer periphery portion, a force outward in the radial direction applied to the ceiling face portion.

The specific thickness of the outer periphery portion depends on the size and material of the lid cover, but can be set to 0.5 to 3 mm, for example. If the outer periphery portion is too thin, there is a risk that a problem occurs in molding, and the strength decreases. On the other hand, if the outer periphery portion is too thick, there is a risk that a force applied outward in the radial direction is unlikely to concentrate on the outer periphery portion. In addition, the width of the outer periphery portion is preferably 0.3 to 3 mm. This is because there is a risk that the force applied outward in the radial direction is unlikely to concentrate on the outer periphery portion, and molding is difficult, if the width is too narrow. On the other hand, if the width is too large, there is a risk that the outer periphery portion is accidentally pierced with the needle of the syringe, or the strength of the ceiling face portion decreases.

Any one of the above-described lid covers is preferably formed of an elastic material whose Shore A hardness is 15 to 50. The Shore A hardness can be measured using a type A durometer, for example. If the Shore A hardness is too high or too low, there is a risk that the airtightness between the lid portion of the medicine container and the lid cover and the airtightness of the above-described needle hole decrease. Note that, for example, a soft elastic material that is widely used particularly in the medical field such as isoprene rubber, silicone rubber, a thermoplastic elastomer or the like can be used as a specific elastic material that forms the lid cover. Accordingly, the lid cover can be pierced with a needle, and can also be mounted to the lid portion of the medicine container so as to further adhere to the peripheral wall portion, due to the elasticity thereof.

In any one of the above-described lid covers, a recessed portion can be formed in the upper face of the ceiling face portion. Thereby, the following effects can be acquired. When the lid cover is mounted, if the lid portion of the medicine container is pressed in to the lid cover, there is a risk that the air is removed from the gap between the peripheral wall portion of the lid cover and the lid portion of the medicine container, and excessive negative pressure is generated in the closed space. Even if negative pressure or even some positive pressure is generated in the closed space, there is almost no influence on the medicine leakage prevention effect of the lid cover of the present invention, but when excessive negative pressure is generated, there arises a risk that a large amount of a medicine in the medicine container is jetted to the closed space due to the pressure difference, and leakage occurs. In view of this, if the recessed portion is formed in the upper face of the ceiling face portion as described above, when the lid portion of the medicine container is pressed in, the recessed portion of the ceiling face portion swells upward, and thus this suppresses leakage of the air, and it is possible to mitigate the generation of negative pressure in the closed space. The shape of the recessed portion is not particularly limited, and can be a shape in which a portion of the ceiling face portion is recessed, and can also be a shape in which a large portion of the ceiling face is recessed in a curved face shape (for example, a spherical shape). Note that the pressure in the closed space due to the lid cover being mounted is preferably negative pressure of −5 KPa or more, for example. Note that the negative pressure of −5 KPa or more here refers to negative pressure of −5 to 0 KPa.

Advantageous Effects of Invention

According to the present invention, even if a medicine leaks out from inside of a medicine container via a needle hole formed in a lid portion of the medicine container by being pierced with a needle of a syringe, the medicine can be prevented from being exposed to the outside space.

DESCRIPTION OF EMBODIMENTS

An embodiment of a lid cover according to the present invention will be described below with reference to the drawings.

1. Configuration of Lid Cover

Figure 1:
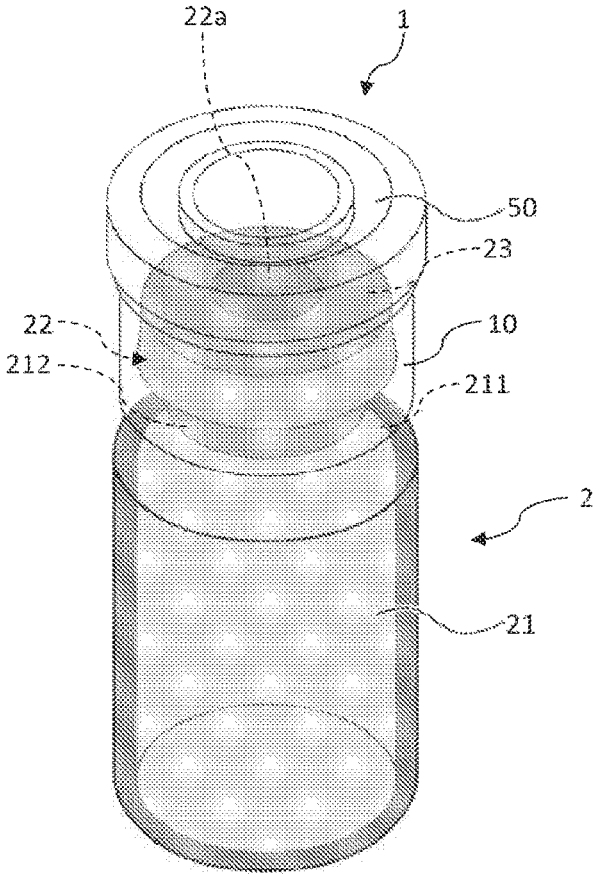
FIG. 1 is a perspective diagram showing the state where a lid cover for a medicine container according to one embodiment of the present invention is fixed to the medicine container.
Figure 7:
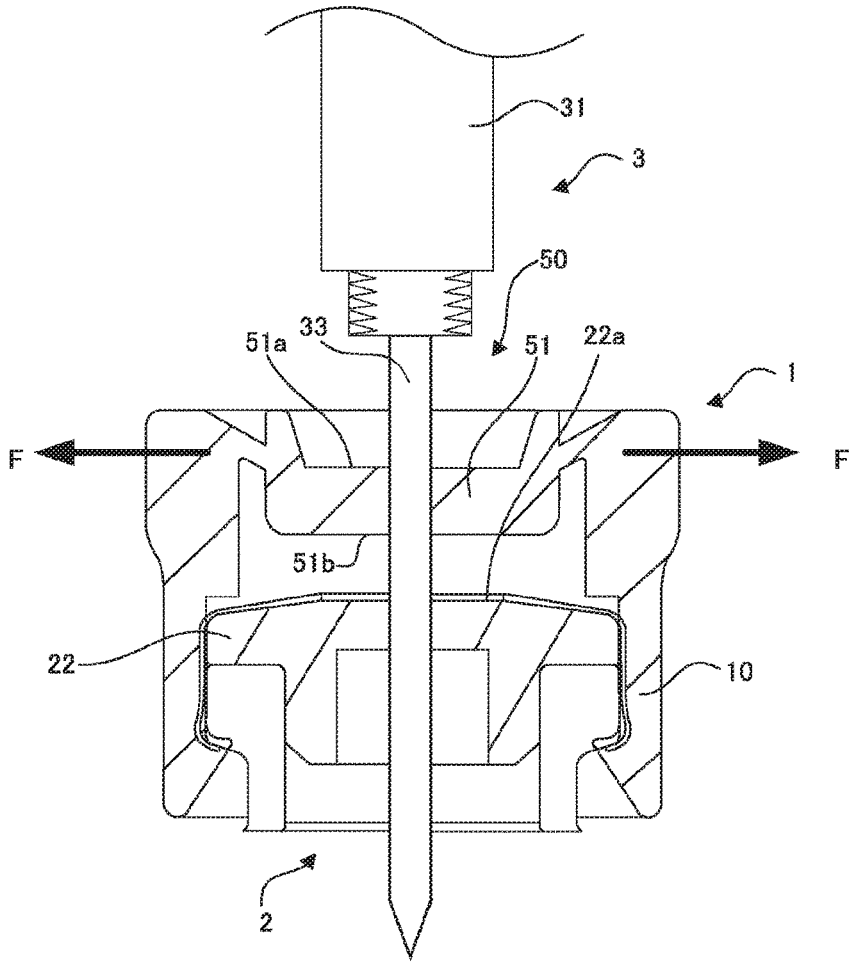
FIG. 7 is a side cross-sectional diagram showing the state where the lid cover (the first state) and the medicine container are pierced with a needle of the syringe.

FIG. 1 is a perspective diagram showing the state where a lid cover 1 according to this embodiment is fixed to a medicine container 2. The lid cover 1 is a tool for preventing a medicine from leaking to the outside space when the medicine, which is air-tightly stored in the medicine container 2, is suctioned using a syringe 3 (see FIG. 2). As shown in FIG. 1, the lid cover 1 is mounted so as to cover a bottle plug 22 (lid portion) of the medicine container 2 during this suctioning operation. A ceiling face portion 50 of the lid cover 1 that covers the bottle plug 22 of the medicine container 2 is then pierced with a needle 33 that is set in the syringe 3, and after that, the bottle plug 22 of the medicine container 2 is subsequently pierced (see FIG. 7). Note that as shown in FIG. 1, the lid cover 1 according to this embodiment is formed to be transparent such that the bottle plug 22 can be visually confirmed from the outside in the state where the lid cover 1 covers the bottle plug 22 of the medicine container 2. However, the configuration of the lid cover 1 is not limited thereto, and the lid cover 1 can be configured to be semitransparent or translucent.

The medicine of interest here is not particularly limited, but is a medicine that could cause a problem when leaked to the outside, for example. Such a medicine is a cytotoxic medicine, for example, and is a medicine that can cause serious side effects, health damage derived from the cytotoxicity, or the like to a person that handles this medicine (which is mainly a medical professional, and is referred to as a user hereinafter) when this person is exposed to the medicine. Examples of such a medicine include anti-malignant tumor agents, immunosuppressants, antivirus agents, antibiotics, radiopharmaceuticals, and the like. Also, other examples of a medicine that can be a problem when exposed to the outside include odorous and irritative medicines, and the like. Note that the medicines includes powdery medicines and the like in addition to liquid medicines, but when suctioning a powdery medicine, before suctioning the medicine, a mixing liquid is injected into the medicine container 2 using the syringe 3, and the medicine is dissolved in the mixing liquid in the medicine container 2.

In the following description of this embodiment, the up-down direction (the vertical direction) and the horizontal direction are defined based on the state where the lid cover 1 is mounted to the medicine container 2, which is the state where the lid cover 1 is on the upper side, and the medicine container 2 is on the lower side, and these directions are not related to the vertical direction in the in-use state of the lid cover 1 and the medicine container 2, unless particularly stated otherwise.

Figure 3:
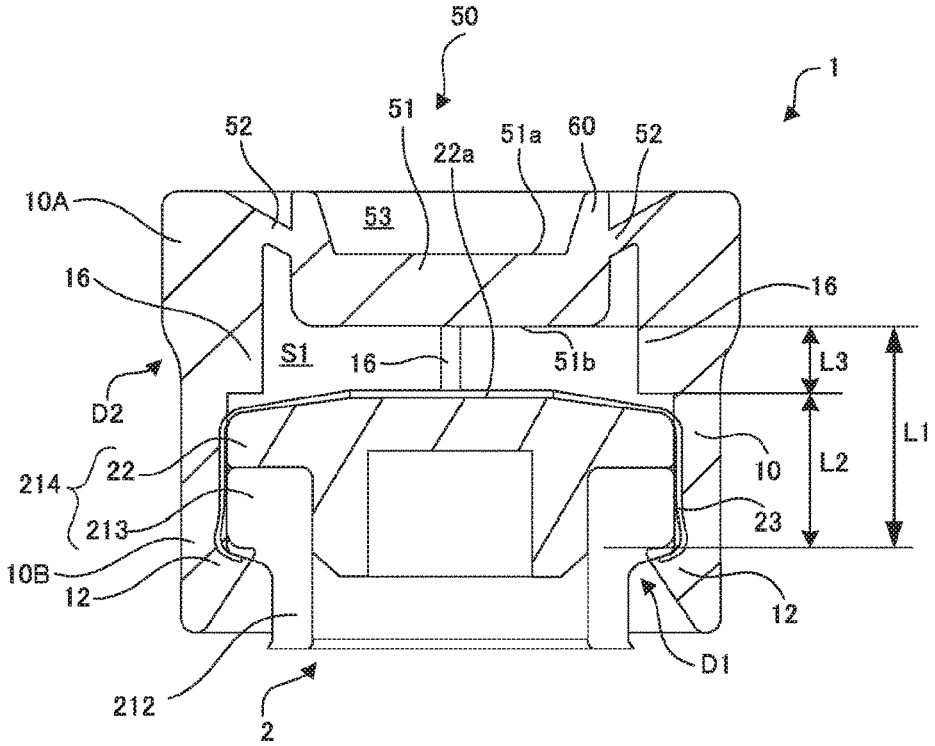
FIG. 3 is a side cross-sectional view of the lid cover (a first state)

First, the medicine container 2 used in this embodiment will be described. As shown in FIG. 1, the medicine container 2 is a container generally called a vial bottle, and has a bottle main body 21 made of glass and the bottle plug 22 that closes the opening formed over this bottle main body 21. The bottle main body 21 is typically transparent or semitransparent. The bottle main body 21 is formed in a substantially columnar shape as a whole, but a neck portion 212 whose diameter is smaller is formed over the bottle main body 21 via a shoulder portion 211. Furthermore, a flange portion 213 (see FIG. 3) is formed on the upper side of the neck portion 212, and the bottle plug 22 is attached to this the flange portion 213. Note that it can be said that the outer periphery portion of the bottle plug 22 and the flange portion 213 forma flange protruding from the neck portion 212 outward in the radial direction as a whole, as shown in FIG. 3. Therefore, hereinafter, the outer periphery portion of the bottle plug 22 and the flange portion 213 are collectively referred to as a flange portion 214.

A portion of the bottle plug 22 that blocks the opening on the upper side of the bottle main body 21 is formed of an elastically deformable material such as rubber or an elastomer, and can be pierced with the needle 33 of the syringe 3. Conversely, when the needle 33 of the syringe 3 is pulled out from this portion, a needle hole formed by inserting the needle 33 is closed almost instantaneously due to its elasticity although it is not complete. Also, this elastically deformable portion is seam-fastened to the flange portion 213 using an aluminum cap 23, and this aluminum cap 23 covers the entirety of this elastically deformable portion excluding a central portion of an upper face 22*a* (piercing face) of the bottle plug 22. Therefore, when accessing the inside of the medicine container 2 using the syringe 3, the bottle plug 22 needs to be pierced with the needle 33 from the circular shaped central portion of the upper face 22*a* of the bottle plug 22.

Figure 2:
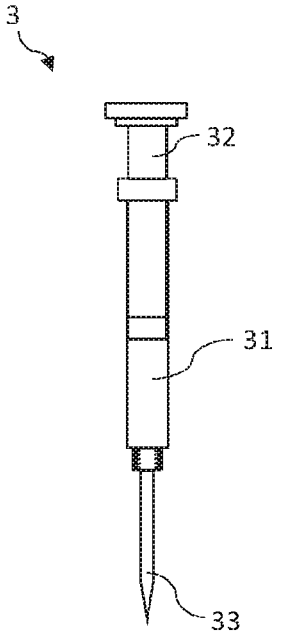
FIG. 2 is a side view of a syringe.

In addition, as shown in FIG. 2, the syringe 3 used in this embodiment has a known and general shape, and includes a cylindrical cylinder 31 and a piston 32 movable inside of this cylinder 31. An opening portion for suctioning and discharging liquid is provided at the tip portion of the cylinder 31, and the needle 33 is mounted to this opening portion.

Subsequently, the lid cover 1 will be described. The entirety of the lid cover 1 in this embodiment is formed of a soft elastic material widely used particularly in the medical field such as isoprene rubber, silicone rubber, or a thermoplastic elastomer, and can be pierced with the needle 33 of the syringe 3. Also, the lid cover 1 can be mounted/removed to/from the bottle plug 22 of the medicine container 2 due to its elasticity. As the material that is used, a material whose Shore A hardness (ASTM D2240) is 15 to 50 is preferred, and a material whose Shore A hardness is 20 to 40 is more preferred. This Shore A hardness can be measured using a type A durometer, for example. Note that the entirety of the lid cover 1 in this embodiment is integrally molded, but in another embodiment, may be acquired by coupling constituent parts after being separately molded. In addition, a molding method is selected from injection molding and the like according to the shape of the lid cover 1 and the like by a person skilled in the art as appropriate.

Figure 4:
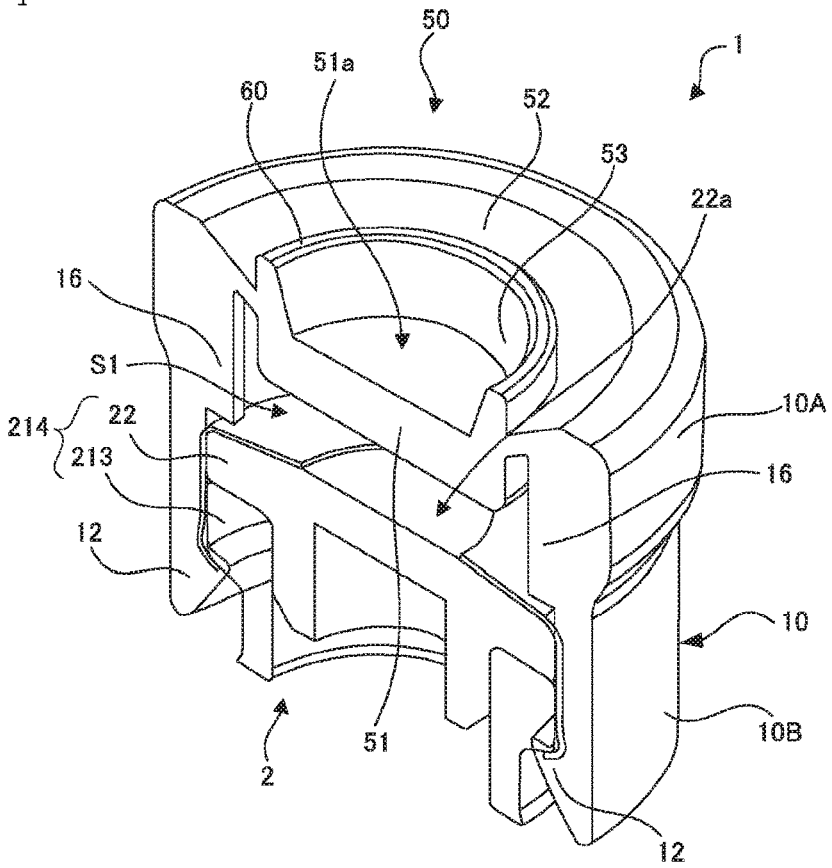
FIG. 4 is a perspective view of the lid cover divided in half in the up-down direction (the first state)
Figure 5:
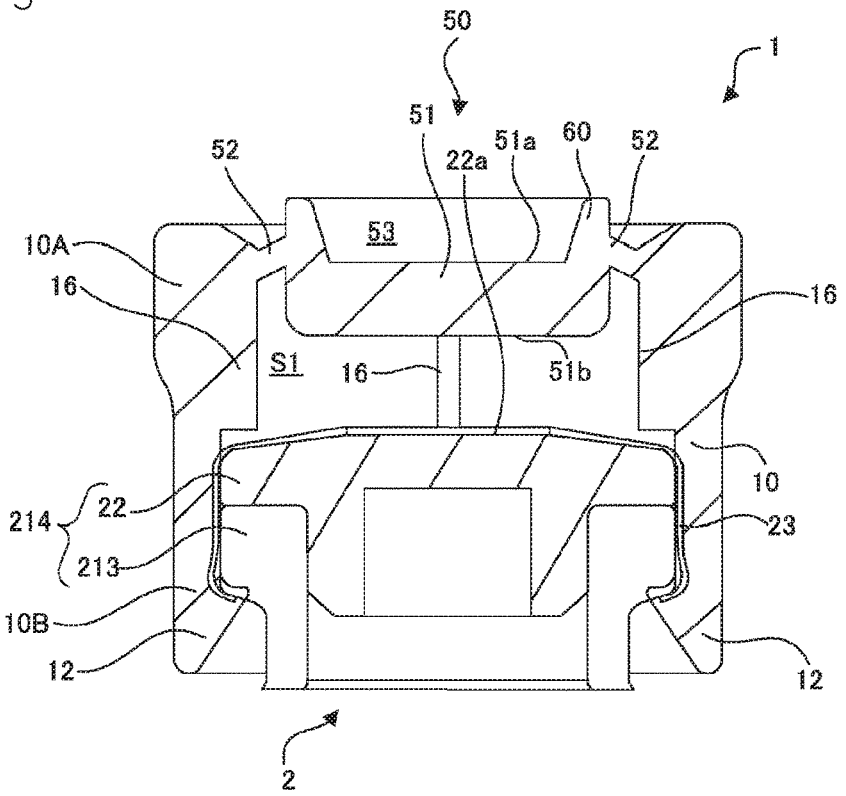
FIG. 5 is a side cross-sectional view of the lid cover after deformation (a second state)

FIG. 3 is a side cross-sectional view of the lid cover 1, and FIG. 4 is a perspective view of the lid cover 1 divided in half in the up-down direction for description. FIGS. 3 and 4 show an upper portion of the medicine container 2 in the state where the lid cover 1 is mounted, for reference. The same applies to FIGS. 5, 7, 9 to 11, 20, 22 and 23 to be described later. As a whole, the lid cover 1 has a shape of a circular cup that is open on the bottom face side as shown in FIGS. 3 and 4, and has a cylindrical peripheral wall portion 10 and the ceiling face portion 50 that is continuous with an upper portion of the peripheral wall portion 10. An annular fastening portion 12 that is caught on the flange portion 214 of the medicine container 2 is continuous with the lower end of the peripheral wall portion 10. The vertical sectional view shape of the fastening portion 12 is a rounded triangular shape in which the apex is directed inward in the radial direction as shown in FIG. 3. The fastening portion 12 protrudes from the inner periphery face of the peripheral wall portion 10 inward in the radial direction. In addition, the peripheral wall portion 10 is constituted by an upper portion 10A and a lower portion 10B that are coupled in the up-down direction, and the external diameter of the upper portion 10A is larger, and the external diameter of the lower portion 10B is smaller. Moreover, ribs 16, which will be described later, are provided in the upper portion 10A.

As shown in FIGS. 3 and 4, the internal diameter of the peripheral wall portion 10 is slightly smaller than the external diameter of the bottle plug 22 of the medicine container 2, and the internal diameter of the fastening portion 12 is also slightly smaller than the external diameter of the bottle plug 22. Therefore, when mounting the lid cover 1 to the bottle plug 22, the lid cover 1 elastically deforms centered on a lower portion of the peripheral wall portion 10 and the fastening portion 12, and thereby the bottle plug 22 is inserted from the fastening portion 12 side into the lid cover 1. At this time, the internal diameter of the peripheral wall portion 10 is slightly smaller than the external diameter of the bottle plug 22 of the medicine container 2, and thus the peripheral wall portion 10 is pressed and widened outward in the radial direction, and thereby the bottle plug 22 and the peripheral wall portion 10 are brought into close-contact state.

Note that in the illustration of FIGS. 3 and 4, the lid cover 1 and the flange portion 214 are overlapped, but in actuality, in the state where the lid cover 1 is mounted to the flange portion 214, the peripheral wall portion 10 and the fastening portion 12 elastically deform according to the outer shape of the flange portion 214, as described above. Therefore, the peripheral wall portion 10 and the fastening portion 12 come into close contact with the flange portion 214 along the peripheral direction without a gap. In addition, at this time, the fastening portion 12 is caught on a step D1 between the flange portion 214 and the neck portion 212, and supports the flange portion 214 from below. Therefore, after the lid cover 1 is mounted to the medicine container 2, the medicine container 2 is prevented from unintentionally coming off from the lid cover 1.

As a result, the entirety of the bottle plug 22 is air-tightly stored in the lid cover 1. This means that, in the state where the lid cover 1 is mounted to the medicine container 2, the upper face 22*a* (piercing face) in the bottle plug 22 that can be pierced with the needle 33 of the syringe 3 is stored air-tightly in the lid cover 1 such that the upper face 22*a* is not exposed to the outside space. In addition, as shown in FIG. 3, a distance L1 from the upper end of the fastening portion 12 to the lower face of the ceiling face portion 50 (more accurately, the lower face 51*b* of a central portion 51 to be described later) is sufficiently longer than the thickness in the up-down direction of the flange portion 214. As a result, in the state where the lid cover 1 is mounted to the medicine container 2, the upper face 22*a* of the bottle plug 22 does not come into contact with the lower face 51*b* of the ceiling face portion 50, and a closed space S1 is formed between the upper face 22*a* of the bottle plug 22 and the ceiling face portion 50. Therefore, even if some medicine leaks out from the inside of the medicine container 2 via a needle hole formed in the bottle plug 22 after the needle 33 of the syringe 3 is removed from the bottle plug 22, the leaked medicine is confined in the closed space S1. Therefore, leakage of the medicine to the outside space is suppressed.

Note that the lid cover 1 is made of a soft elastic material as described above, and thus if a medicine container that has a bottle plug whose shape and size are slightly different is handled, the bottle plug can also be stored air-tightly in the lid cover 1.

In addition, a plurality of (in this embodiment, four) ribs 16 (restriction members) arranged in the peripheral direction at equal intervals are formed integrally on the inner periphery face of the peripheral wall portion 10. Each of the ribs 16 is formed in a plate shape extending in the up-down direction, and protrudes from the inner periphery face of the peripheral wall portion 10 inward in the radial direction. The positions of the lower ends of these ribs 16 are aligned in the up-down direction, and a distance L2 from the lower end of the ribs 16 to the upper end of the fastening portion 12 is generally equal to the thickness in the up-down direction of the flange portion 214. Therefore, a sufficient length is secured as a distance L3 from the lower end of the ribs 16 to the lower face 51*b* of the ceiling face portion 50.

Additionally, as is clear from the above description, the bottle plug 22 inserted from below the peripheral wall portion 10 into the peripheral wall portion 10 is blocked by the ribs 16, and cannot enter further upward of the lower end position of the ribs 16. Specifically, the ribs 16 have a role of preventing the bottle plug 22 inserted from below the peripheral wall portion 10 into the peripheral wall portion 10 from reaching the lower face 51*b* of the ceiling face portion 50, so as to secure the closed space S1. In addition, the distance L2 is set as described above, and thus, in addition to the above-described role, the ribs 16 also have a role of restricting the flange portion 214 so as not to be able to move in the closed space S1 in the up-down direction, and eventually, fixing the lid cover 1 to the medicine container 2. In addition, movement in the right-left direction of the flange portion 214 is also restricted by the peripheral wall portion 10. As a result, after the lid cover 1 is mounted to the medicine container 2, it is prevented that the lid cover 1 comes off accidentally and the medicine confined in the closed space S1 leaks to the outside space.

In addition, in this embodiment, the outer periphery face of the peripheral wall portion 10 has a step D2 in the up-down direction, but in another embodiment, the step does not need to be provided.

As shown in FIGS. 3 and 4, the ceiling face portion 50 has a disk-shaped central portion 51 and an annular outer periphery portion 52 that surrounds the central portion 51. The outer periphery portion 52 is continuous with the upper portion of the peripheral wall portion 10 and the outer peripheral edge of the central portion 51. Additionally, the outer periphery portion 52 is inclined toward the central portion 51, and the upper face 51*a* of the central portion 51 is positioned lower than the upper portion of the peripheral wall portion 10. Accordingly, the ceiling face portion 50 has a shape in which the central portion 51 thereof is recessed downward. Note that an aspect of the inclination of the outer periphery portion 52 in this embodiment is linear in a vertical sectional view. The inclination of the outer periphery portion 52 is convenient, since it becomes possible to prevent a force applied outward in the radial direction from reaching the central portion. In addition, the central portion 51 preferably has a certain thickness such that the needle 33 with which the central portion 51 is pierced can be tightly held and liquid leakage does not occur, and a thickness of about 3 to 10 mm is generally preferred, and a thickness of about 3 to 6 mm is more preferred.

On the other hand, the outer periphery portion 52 is thinner than the central portion 51, and can deform more easily than the outer periphery portion 52. Specifically, the thickness of the outer periphery portion 52 depends on the material that forms the lid cover 1, but the thickness of the outer periphery portion 52 is preferably about 0.5 to 3 mm, and more preferably, is about 1 to 3 mm. This is because, if the outer periphery portion 52 is too thin, there is a risk that a problem in molding occurs, and the strength of the ceiling face portion 50 decreases. Also, if the outer periphery portion 52 is too thick, force applied outward in the radial direction to be described later is unlikely to be concentrated on the outer periphery portion 52. Furthermore, in order to make it easier for the outer periphery portion 52 to deform, the width of the outer periphery portion 52 (the length in the radial direction) is preferably about 0.3 to 3 mm. This is because, if the width of the outer periphery portion 52 is too narrow, there is a risk that the force applied outward in the radial direction to be described later is unlikely to be concentrated on the outer periphery portion, and molding becomes difficult. Also, if the width of the outer periphery portion 52 is too large, there is a risk that the outer periphery portion 52 is accidentally pierced with a needle, or the strength decreases. The width of the outer periphery portion 52 is more suitably about 0.3 to 2 mm. In order to further concentrate the force outward in the radial direction to be described later more on the outer periphery portion 52, the ratio of the thickness of the central portion 51 to the thickness of the outer periphery portion 52 is preferably 2 to 10, and more preferably, is 2 to 7.

In addition, as shown in FIGS. 3 and 4, an annular protrusion 60 protruding from the upper face 51*a* of the central portion 51 is formed on the ceiling face portion 50. Thereby, a recessed portion 53 surrounded by the central portion 51 and the annular protrusion 60 is formed at the upper end of the ceiling face portion 50. In addition, this annular protrusion 60, the central portion 51, and the bottle plug 22 of the medicine container 2 are generally concentric with each other in the state where the lid cover 1 is mounted to the medicine container 2. Therefore, by referencing the annular protrusion 60, the user can easily insert the needle 33 of the syringe 3 substantially at the center of the central portion 51, and eventually, substantially at the center of the bottle plug 22 of the medicine container 2. Accordingly, the user can easily position the needle 33 of the syringe 3 relative to the lid cover 1 and the bottle plug 22. Note that as shown in FIGS. 3 and 4, the height position in the up-down direction of the upper end of the annular protrusion 60 in this embodiment is aligned with the height position in the up-down direction of the upper end of the peripheral wall portion 10 in a first state. However, in another embodiment, in the first state, the annular protrusion 60 may extend to a position higher than the upper end of the peripheral wall portion 10, or may extend only to a position lower than the upper end of the peripheral wall portion 10.

2. How to Use Lid Cover

Next, a method for suctioning a medicine using the lid cover 1 will be described. Here, a situation will be described in which a mixed medicine to be administered to a patient is prepared by suctioning a medicine using the syringe 3, and then injecting this medicine into a mixing-liquid container 4 that contains a mixing liquid. First, the mixing-liquid container 4 used here will be described.

Figure 6:
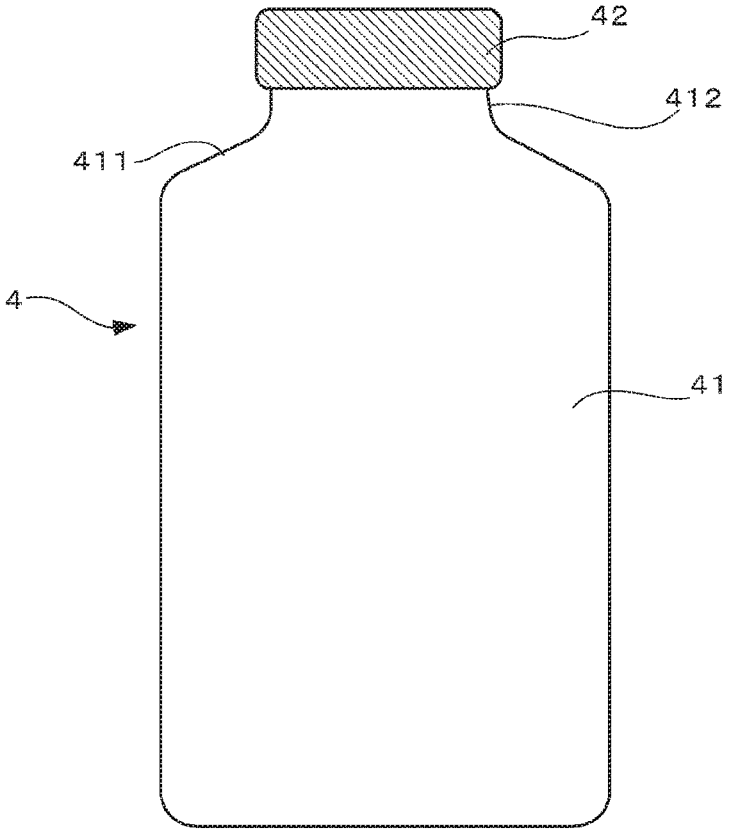
FIG. 6 is a side cross-sectional view of a mixing-liquid container.

As shown in FIG. 6, the mixing-liquid container 4 has a bottle main body 41 made of plastic and a bottle plug 42 that closes an opening formed in an upper portion of this bottle main body 41. The bottle main body 41 is formed in a substantially oval shape as a whole, but similarly to the medicine container 2, a neck portion 412 whose diameter is smaller is formed over the bottle main body 41 via a shoulder portion 411. Furthermore, a flange portion (not illustrated) is formed in an upper portion of the neck portion 412, and the bottle plug 42 is attached to this flange portion. Note that the bottle plug 42 is attached to the flange portion by welding so as to block the opening of the bottle main body 41. In the bottle plug 42, a portion that blocks the opening of the bottle main body 41 is formed of an elastic material such as rubber or an elastomer similarly to the medicine container 2, and can be pierced with the needle 33 of the syringe 3. Note that the mixing-liquid container 4 does not need to be in the form of a bottle, and a bag-type container can also be used of course. Mixing liquid that is stored in this mixing-liquid container 4 is physiological salt water, a Ringer's solution, distilled water or the like, which is a solution for diluting and dissolving a medicine.

The user prepares the syringe 3, the mixing-liquid container 4, an appropriate number of medicine containers 2 and as many lid covers 1 as the medicine containers 2, when preparing a mixed medicine. Subsequently, the user attaches the lid covers 1 to the medicine containers 2 as shown in FIG. 1. At this time, the fastening portion 12 is brought into tight contact with the flange portion 214 such the bottle plug 22 is air-tightly confined in the lid cover 1. Thereby, the bottle plug 22 is fixed tightly in the lid cover 1. At this time, when the bottle plug 22 of the medicine container 2 is pressed into the lid cover 1, the air is removed from the gap between the peripheral wall portion 10 of the lid cover 1 and the bottle plug 22, and furthermore, the ribs 16 are pressed when the bottle plug 22 is pressed in, and thus there is a risk that the closed space S1 expands due to subsequent restoration of the ribs 16, and excessive negative pressure is generated in the closed space S1. Even if negative pressure or even some positive pressure is generated in the closed space S1, there is almost no influence on the medicine leakage prevention effect, but when excessive negative pressure is generated, there arises a risk that the medicine in the medicine container 2 is jetted into the closed space in a large amount due to the pressure difference, and leakage occurs contrary to expectations. Therefore, the pressure in the closed space S1 is preferably negative pressure of −5 kPa or more, for example. Note that the negative pressure of −5 KPa or more refers to negative pressure of −5 to 0 KPa as described above.

After the bottle plugs 22 of the medicine containers 2 are covered by the lid covers 1, the medicine is suctioned from the medicine containers 2 using the syringe 3. Specifically, the following operation is performed on each set of the medicine container 2 and the lid cover 1. The central portion 51 is pierced with the needle 33 aiming at the center of the central portion 51 of the ceiling face portion 50 of the lid cover 1 by referencing the annular protrusion 60. Subsequently, when further inserting the needle 33, the needle 33 is inserted generally along the central axis of the bottle plug 22 of the medicine container 2 (see FIG. 7). At this time, in order to easily suction the entire amount of medicine using the syringe 3, the directions of the lid cover 1 and the medicine container 2 are adjusted so as to position the lid cover 1 under the medicine container 2 in the vertical direction such that the medicine is collected on the bottle plug 22 side. As described above, when the needle 33 enters the medicine container 2 from the bottle plug 22, and comes into contact with the medicine, the piston 32 is pulled so as to suction the medicine. If the medicine container 2 is brought into a negative pressure state due to the suctioning, and the operation becomes difficult, it suffices that substantially the same amount of air as the amount of the medicine to be suctioned is suctioned into the syringe 3 before suctioning the medicine, and the medicine is suctioned by a piston movement while replacing this air with the medicine in the medicine container 2.

Subsequently, when an appropriate amount of medicine is suctioned into the cylinder 31, the needle 33 is pulled out from the bottle plug 22 and the lid cover 1. At this time, the bottle plug 22 is maintained in the state of being covered by the lid cover 1. Thus, at this time, even if the medicine leaks from the medicine container 2 along with the needle 33 being pulled out, this medicine is confined in the closed space S1 enclosed by the lid cover 1. In addition, when pulling out the needle 33 from the lid cover 1, the needle 33 is pulled out while being rubbed by the lid cover 1, and thus the medicine adhering to the needle 33 is likely to stay in the closed space S1.

In addition, the annular protrusion 60 protruding upward from the central portion 51 of the ceiling face portion 50 of the lid cover 1 prevents the user from touching the central portion 51 that has been pierced with the needle 33. Therefore, also from this viewpoint, possibility the user being exposed to the medicine is reduced.

After the medicine is suctioned from the medicine containers 2 one after another in this manner, the user pierces the bottle plug 42 of the mixing-liquid container 4 with the needle 33 of the syringe 3, and presses the piston 32 in. Thereby, all the medicine in the syringe 3 is injected into the mixing-liquid container 4, and the medicine and the mixing liquid are mixed. A mixed medicine is prepared in this manner. Note that in the case of performing the above operation of suctioning medicine on a plurality of medicine containers 2, the same syringe 3 may be used, or the syringe 3 may be replaced midway in this processing.

After that, the user carries the mixing-liquid container that contains the mixed medicine to the patient, and administers the mixed medicine in the mixing-liquid container 4 to the patient by a method such as intravenous drip. In addition, after the operation of suctioning/mixing the medicine, the user discards the syringe 3, the medicine container 2, and the lid cover 1. At this time, the medicine container 2 is not removed from the lid cover 1, and is discarded along with the lid cover 1, in the state where the bottle plug 22 is stored in the closed space S1 inside of the lid cover 1. Therefore, the lid cover 1 and the medicine container 2 that have possibility of being contaminated by the medicine can be discarded safely.

In the above description, the case where the medicine is liquid has been described, but in the case where the medicine is powdery, the operation is performed as follows. First, the mixing-liquid container 4 is pierced with the needle 33 of the syringe 3, and the mixing liquid is suctioned into the syringe 3. Subsequently, the needle 33 of the syringe 3 is then pulled out of the mixing-liquid container 4, and after that, the lid cover 1 and further the medicine container 2 are pierced with the needle 33. In this state, the piston 32 is pressed in, and the mixing liquid in the syringe 3 is injected into the medicine container 2. Thereby, a powdery medicine and mixing liquid are mixed, and a liquid medicine is prepared. After that, this liquid medicine is suctioned, and the medicine is held in the syringe 3. Subsequently, the bottle plug 42 of the mixing-liquid container 4 is pierced with the needle 33 of the syringe 3, and the medicine in the syringe 3 is injected into the mixing-liquid container 4. Similarly, regarding the other medicine containers, mixing liquid is injected so as to prepare a liquid medicine, and the liquid medicine is then suctioned using the syringe 3 and mixed with the mixing liquid such that a mixed medicine is prepared as described above. Note that the mixing liquid that is injected into the medicine container 2 does not need to be mixing liquid suctioned from the mixing-liquid container 4 for preparing a mixed medicine, and other mixing liquid for dissolution and dilution can also be used.

3. Characteristics

As described above, according to this embodiment, the ceiling face portion 50 has the central portion 51 that is pierced with the needle 33 of the syringe 3 and the thin outer periphery portion 52 formed in the periphery of this central portion 51, and thus the airtightness of a needle hole formed in the central portion 51 by the needle 33 of the syringe 3 can be maintained high. The following is considered to be a reason for this. When the lid cover 1 is mounted to the bottle plug 22 of the medicine container 2, the peripheral wall portion 10 is pressed and widened outward in the radial direction by the bottle plug 22, and thus accompanied by this, a force spreading outward in the radial direction (e.g., an arrow F in FIG. 7) is also applied to the ceiling face portion 50 of the lid cover 1. Thereby, the force is applied to the ceiling face portion 50 such that a needle hole that is a gap between the needle 33 and the ceiling face portion 50 that is pierced with the needle 33 and a needle hole after the needle is pulled out expand. On the other hand, in this embodiment, the thin outer periphery portion 52 is formed in the periphery of the central portion 51 that is pierced with a needle, and thus a force F applied outward in the radial direction is mainly concentrated on the outer periphery portion 52 that is likely to deform elastically, and does not reach the central portion 51. As a result, the needle hole is prevented from expanding, and the airtightness of the needle hole of the ceiling face portion 50 can be maintained high. Therefore, even if the medicine leaks out from the inside of the medicine container 2 to the closed space S1 via the needle hole formed in the bottle plug 22 of the medicine container 2 by being pierced with the needle 33 of the syringe 3, it is possible to prevent the exposure from reaching the outside space. This point is an effect acquired both when the needle is being inserted and after the needle is pulled out. Furthermore, the airtightness of the needle hole is high, and thus when pulling out the needle 33, the medicine that adheres to the needle tip is wiped off substantially completely. Thus, the exposure prevention effect can be improved also in this regard.

4. Modified Examples

Several embodiments of the present invention are described above, but the present invention is not limited to the above embodiments, and various modifications can be made without departing from the gist of the present invention. Also, the matter of the following modified examples can be combined as appropriate.

1

Figure 8:
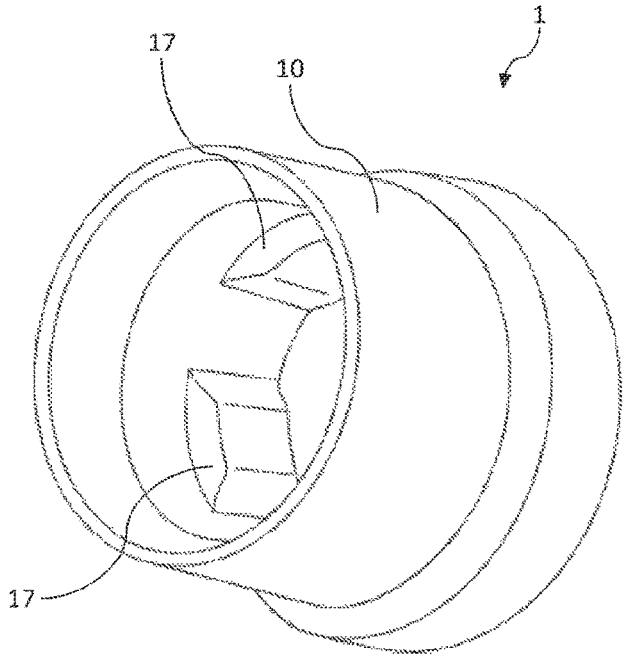
FIG. 8 is a perspective view of a lid cover according to a modified example when viewed from an opening side in a lower portion.

For example, projection portions 17 (restriction members) as shown in FIG. 8 may be formed on the inner periphery face of the peripheral wall portion 10 instead of the above ribs 16. These projection portions 17 are acquired by increasing the width of the ribs 16 in the peripheral direction, and the size in the up-down direction can be similar to that of the ribs 16. In addition, such projection portions may be formed to be continuous so as to extend over the entirety of the peripheral direction, rather than being configured to be discontinuous in the peripheral direction. Furthermore, the projection portions do not need to extend in the up-down direction to the lower face 51*b* of the ceiling face portion 50, and may be dot-like projection portions, for example. A configuration may also be adopted in which such projection portions (including the ribs 16) for restricting entry of the bottle plug 22 of the medicine container 2 into the peripheral wall portion 10 are not provided on the inner periphery face of the peripheral wall portion 10. Note that the ribs 16 and projection portions 17 are not necessarily required. This applies to the modified examples to be descried later.

2

Figure 9:
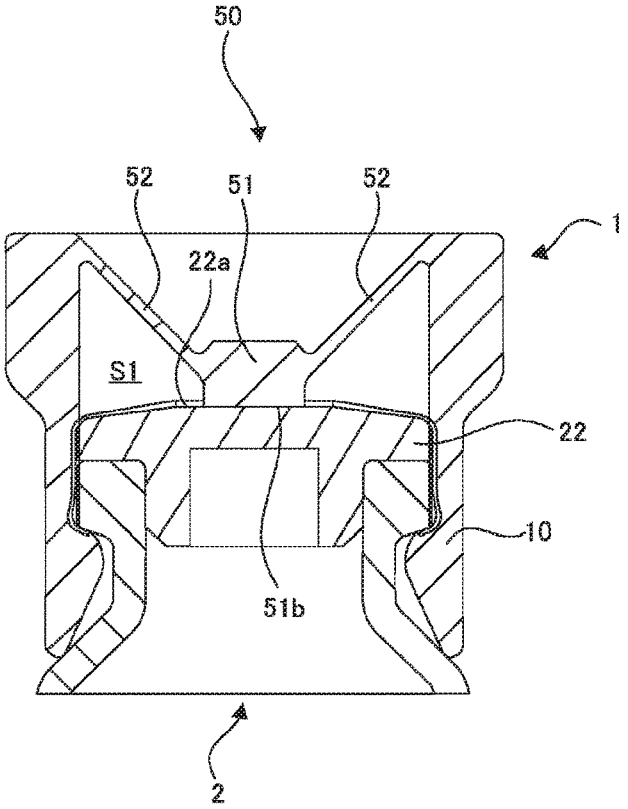
FIG. 9 is a side cross-sectional view of a lid cover according to another modified example (the first state)

The configuration of the outer periphery portion 52 is not limited to the above configuration, and it suffices for at least the thickness of the outer periphery portion 52 to be thinner than the thickness of the central portion 51. For example, in an initial state, the outer periphery portion 52 may extend from the upper portion of the peripheral wall portion 10 further downward than the above embodiment. In addition, at this time, the outer periphery portion 52 may be configured such that the lower face 51*b* of the central portion 51 of the ceiling face portion 50 and the upper face 22*a* of the bottle plug 22 come in contact in the initial state, as shown in FIG. 9, for example. Also in this case, when removing the needle 33 of the syringe 3, the central portion 51 is lifted upward, and thus the contact state is released, and the medicine can be confined in the closed space S1.

Figure 10:
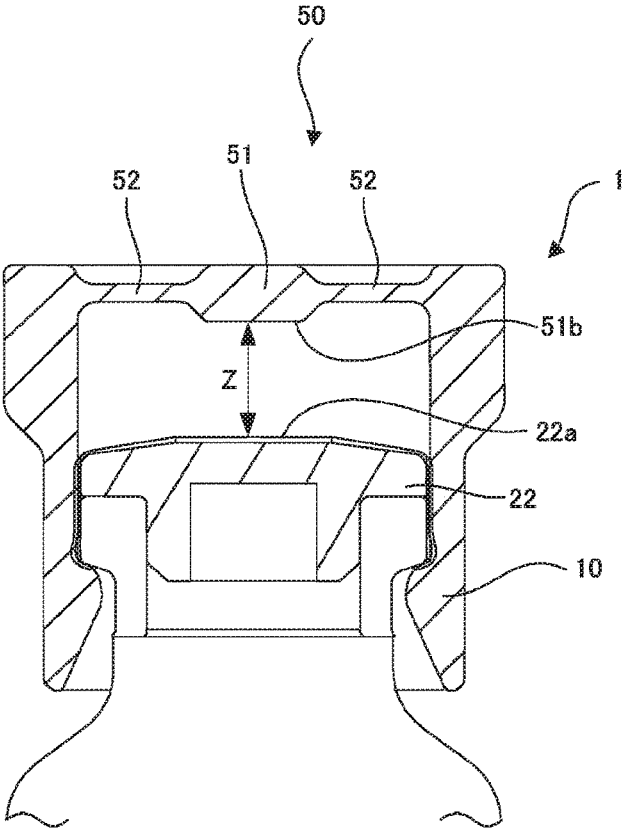
FIG. 10 is a side cross-sectional view of a lid cover according to still another modified example.

It suffices for the ceiling face portion 50 of the lid cover 1 to be configured to deform elastically such that the distance between the ceiling face portion 50 and the piercing face changes, and the aspect is not limited particularly. For example, a configuration can also be adopted in which, in the initial state, the outer periphery portion 52 extends in the horizontal direction, and the central portion 51 is not recessed relative to the peripheral wall portion 10, as shown in FIG. 10.

Figure 11A:
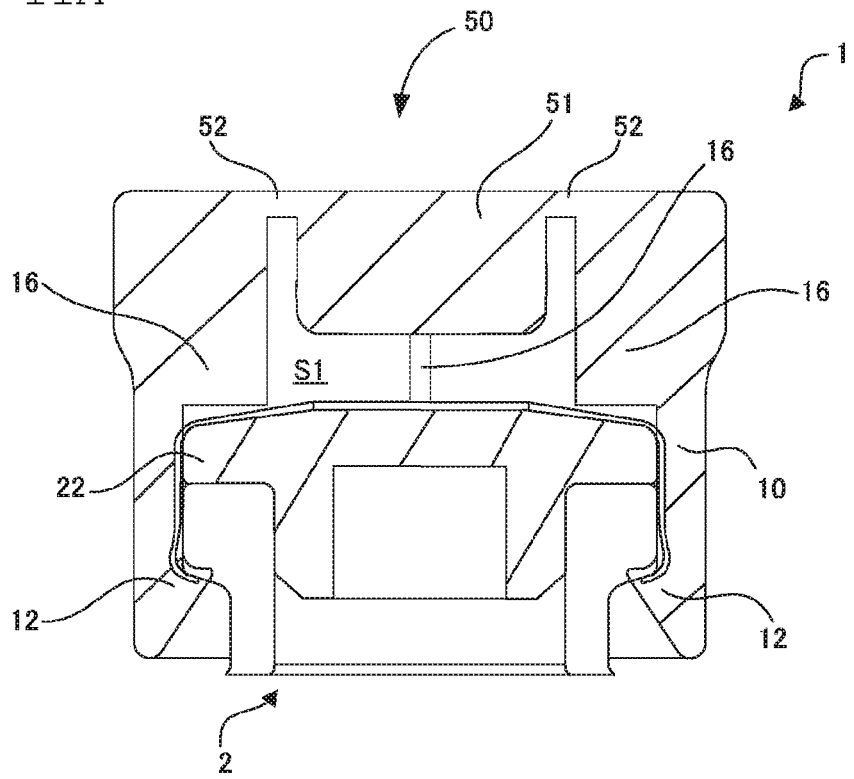
FIG. 11A is a side cross-sectional view of a lid cover according to still another modified example.
Figure 11B:
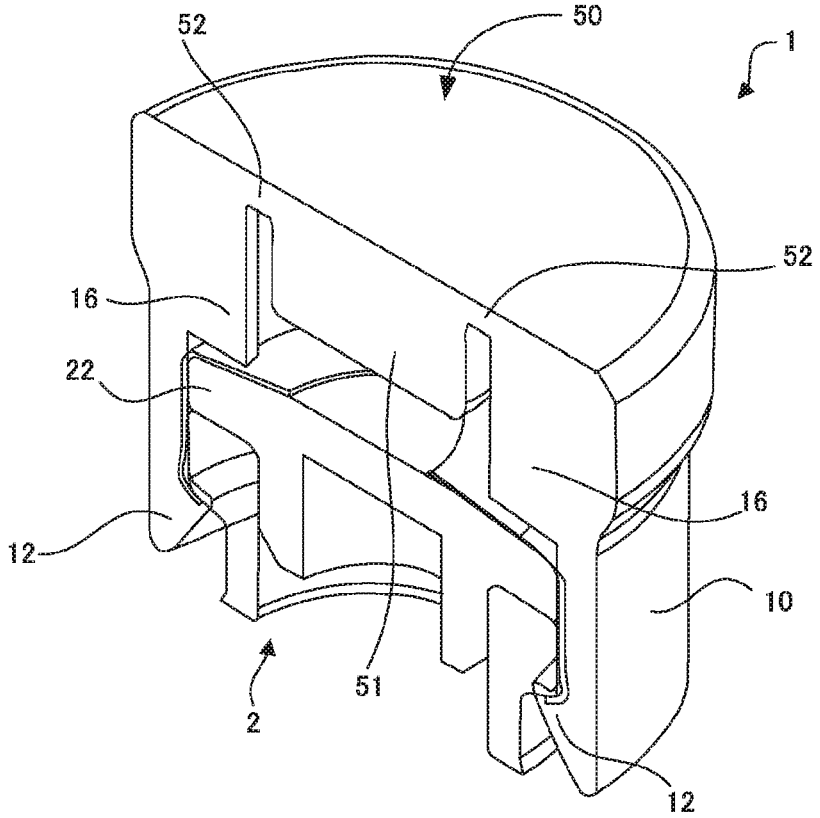
FIG. 11B is a perspective view of a lid cover according to still another modified example.
Figure 12:
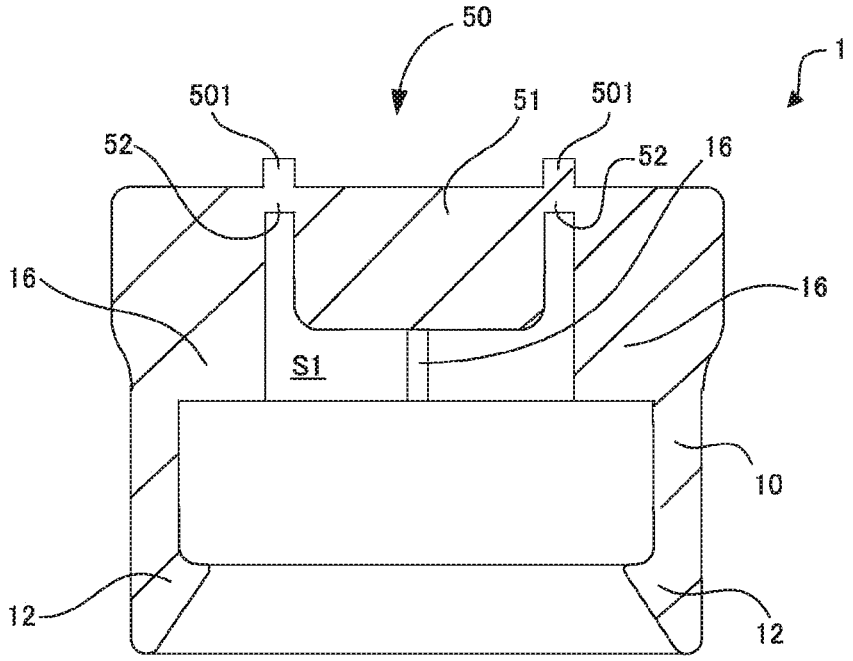
FIG. 12 is a side cross-sectional view of a lid cover according to still another modified example.
Figure 13:
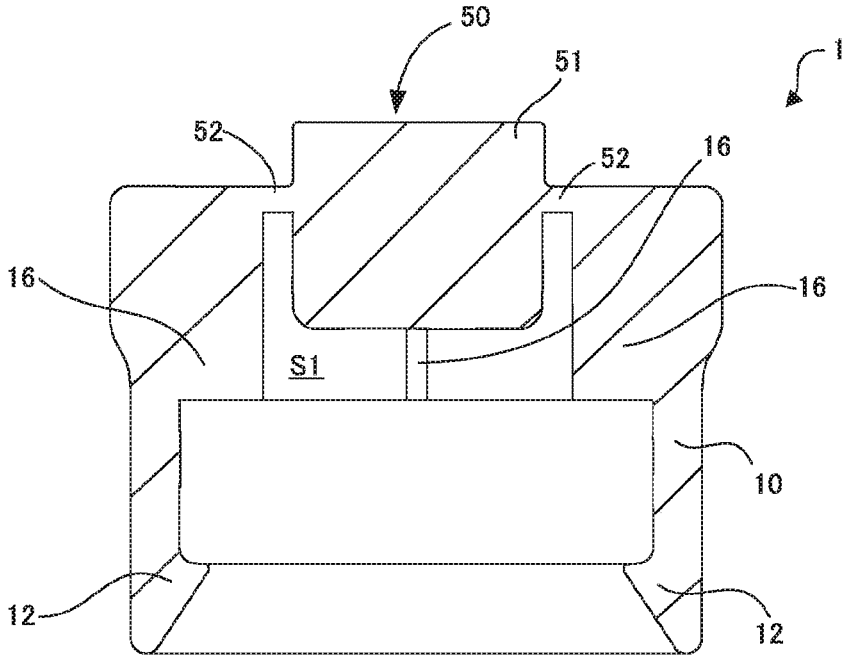
FIG. 13 is a side cross-sectional view of a lid cover according to still another modified example.
Figure 14:
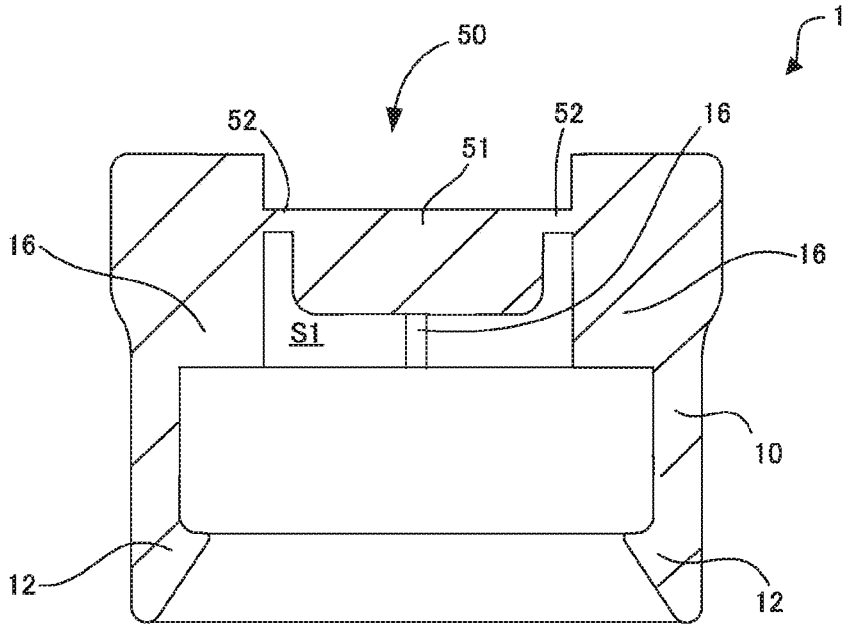
FIG. 14 is a side cross-sectional view of a lid cover according to still another modified example.
Figure 15:
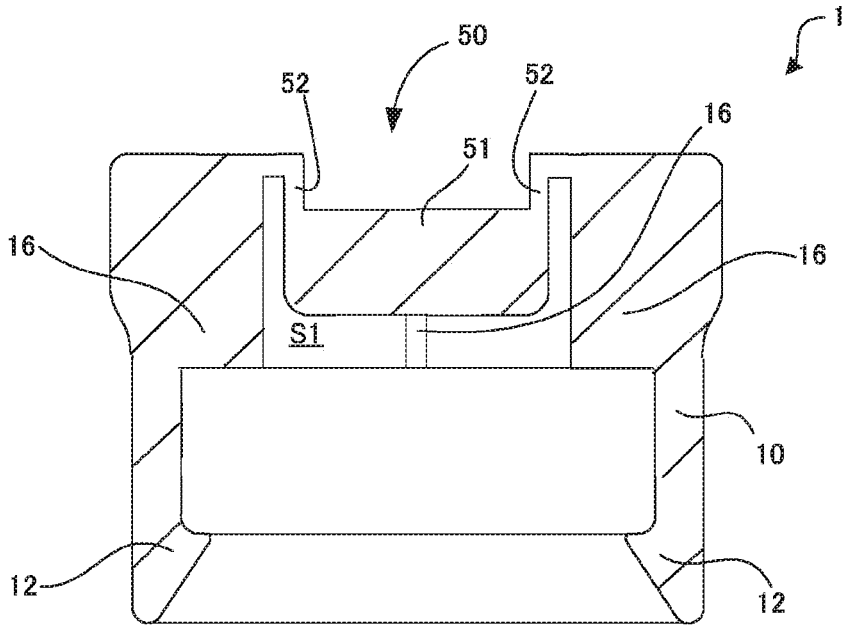
FIG. 15 is a side cross-sectional view of a lid cover according to still another modified example.

The ceiling face portion 50 can also be flat as shown in FIG. 11. In this case, the central portion 51 and the upper face of the outer periphery portion 52 are flush with each other, and the outer periphery portion 52 is thinner, and thus the central portion 51 is in a form of protruding on the bottle plug 22 side of the medicine container 2. Here, it is preferable that the central portion 51 can be visually confirmed with ease from the outside such that the central portion 51 can be reliably pierced with the needle 33 of the syringe 3. Therefore, for example, an annular projection portion 501 can be formed in the upper face of the central portion 51 along the peripheral edge of the upper face of the central portion 51 as shown in FIG. 12. In addition, as shown in FIG. 13, an aspect is also possible in which only the central portion 51 protrudes upward from the ceiling face portion 50. Alternatively, as shown in FIG. 14, the central portion and the outer periphery portion can be formed to be lower than the outer peripheral edge of the ceiling face portion such that the central portion is recessed downward from the ceiling face portion. Note that in the above examples, the outer periphery portion is formed so as to extend horizontally from the central portion outward in the radial direction, but for example, as shown in FIG. 15, a configuration can also be adopted in which the outer periphery portion is formed so as to extend upward from the peripheral edge of the central portion, and the end portion of the outer periphery portion is coupled to the outer peripheral edge of the ceiling face portion.

3

Figure 16:
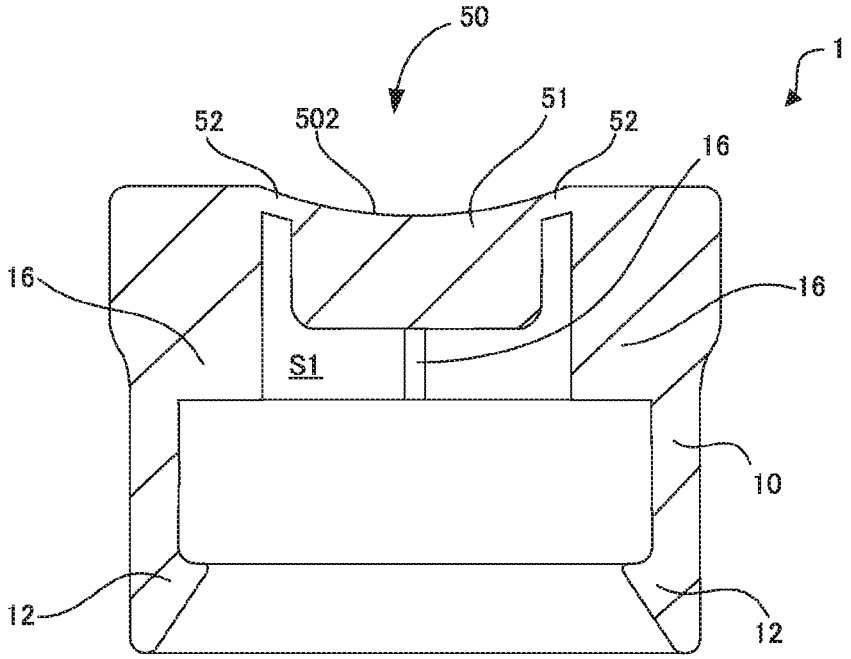
FIG. 16 is a side cross-sectional view of a lid cover according to still another modified example.

Also, as shown in FIG. 16, a recessed portion 502 can be formed in the upper face of the ceiling face portion 50. This recessed portion 502 has a curved shape in a cross-sectional view, and thereby the ceiling face portion 50 is likely to swell upward. Therefore, the following effect can be acquired. As described above, when the bottle plug 22 of the medicine container is pressed into the lid cover, there is a risk that the air is removed from the gap between the peripheral wall portion 10 of the lid cover 1 and the bottle plug 22, generating excessive negative pressure in the closed space S1. In view of this, if the recessed portion 502 is formed in the upper face of the ceiling face portion 50 as described above, when the bottle plug 22 is pressed in, the recessed portion 502 swells upward, and thus leakage of air is thereby suppressed, and it is possible to mitigate generation of negative pressure in the closed space S1.

In addition, if the ribs 16 are formed in the lid cover 1, the ribs 16 are pressed when the bottle plug 22 is pressed in, and thus the closed space S1 expands due to subsequent restoration of the ribs 16. However, as described above, if the recessed portion 502 is formed, such expansion of the closed space S1 is mitigated due to restoration from swelling of the recessed portion 502. As a result, it is possible to prevent generation of excessive negative pressure in the closed space S1. As described above, for example, the pressure in the closed space S1 preferably becomes negative pressure of −5 KPa or more such that excessive negative pressure is not generated as in the above description.

4

Figure 17:
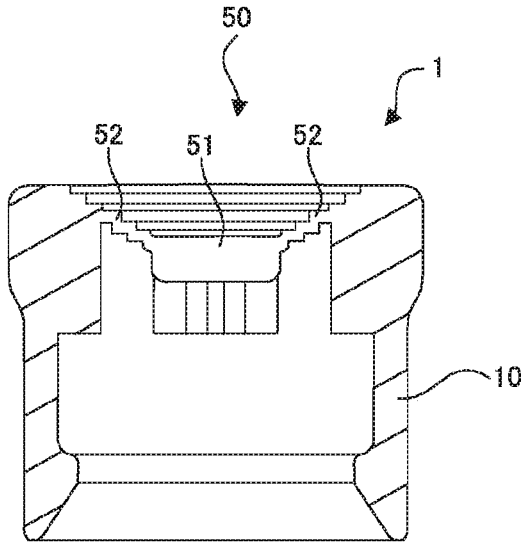
FIG. 17 is a side cross-sectional view of a lid cover according to still another modified example.
Figure 18:
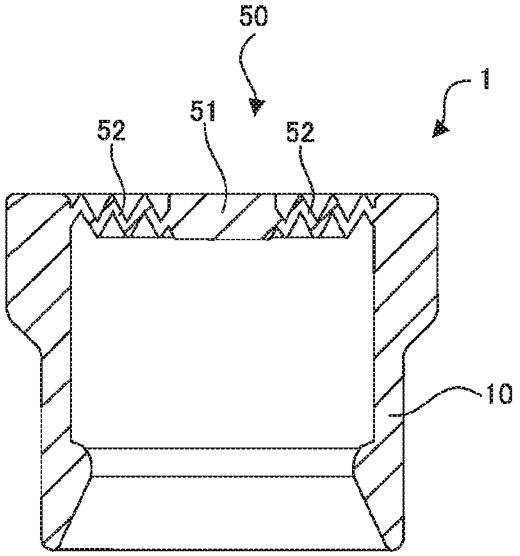
FIG. 18 is a side cross-sectional view of a lid cover according to still another modified example.

As shown in FIGS. 17 and 18, the outer periphery portion 52 may have a zigzag shape in a vertical sectional view. FIG. 17 shows an example in which the outer periphery portion 52 is formed in a step-like shape. FIG. 18 shows an example in which the outer periphery portion 52 is formed in a bellows shape, and in this case, the ceiling face portion 50 is likely to deform so as to be deflected upward. Even in such a form, the above effect can be acquired as long as the outer periphery portion 52 is thinner than the central portion 51.

5

Figure 19:
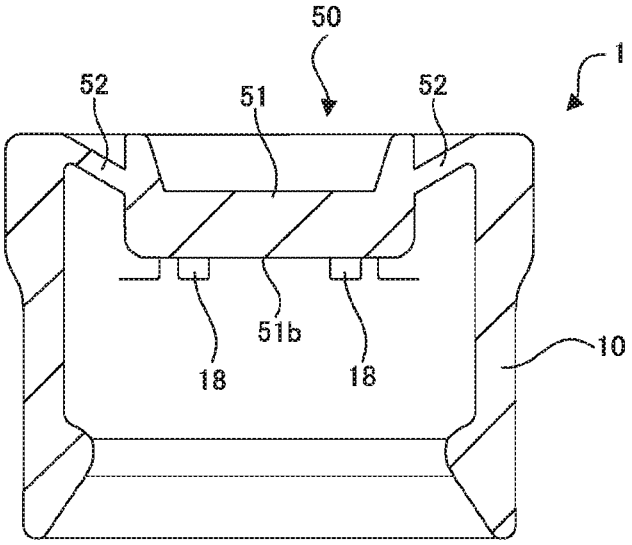
FIG. 19 is a side cross-sectional view of a lid cover according to still another modified example.

In the above embodiment, for example, projection portions 18 (restriction members) as shown in FIG. 19 may be formed in the lower face 51*b* of the ceiling face portion 50 instead of the ribs 16. In this case, due to the existence of these projection portions 18, a certain distance corresponding to the height of the projection portions 18 is reliably held between the lower face 51*b* of the ceiling face portion 50 and the upper face 22*a* of the bottle plug 22, and the closed space S1 for confining a medicine is secured. Note that the ribs 16 and the projection portions 18 may be provided at the same time so as to adopt a configuration in which the height position in the up-down direction of the lower end of the ribs 16 and the height position in the up-down direction of the lower end of the projection portions 18 are generally equal.

6

Figure 20:
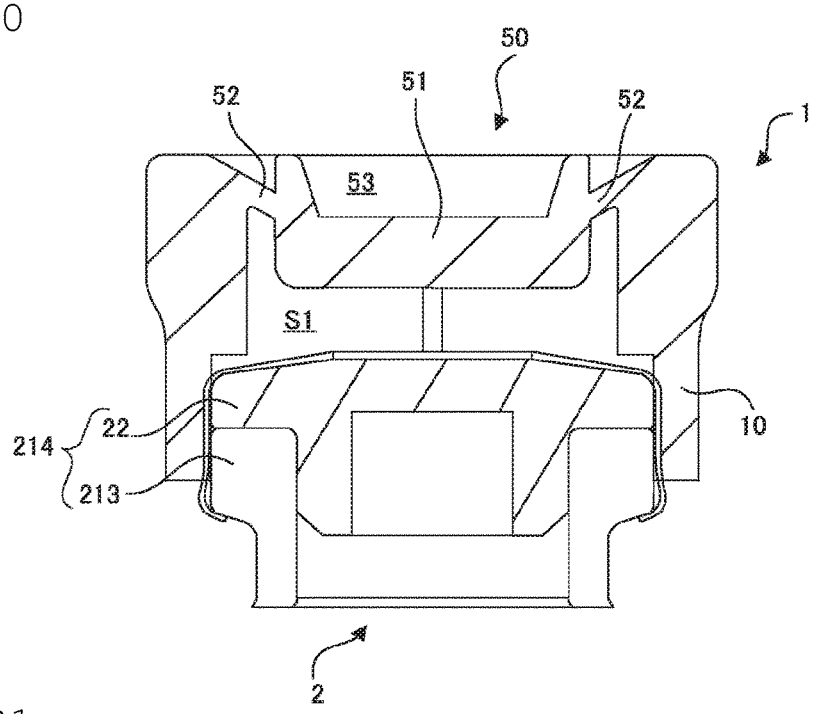
FIG. 20 is a side cross-sectional view of a lid cover according to still another modified example.

In the above embodiment, the lid cover 1 is configured to air-tightly cover the entirety of the flange portion 214 of the medicine container 2. However, in the bottle plug 22, as long as a portion pierced with the needle 33 (the central portion of the upper face 22*a*) is covered air-tightly, the entirety of the flange portion 214 does not need to be necessarily covered air-tightly, and the lid cover can be configured as shown in FIG. 20, for example. In this example in which the fastening portion 12 is omitted from the lid cover 1, the inner periphery face of the peripheral wall portion 10 is securely in close contact with the outer periphery surface of the flange portion 214, and thereby the lid cover 1 is fixed to the medicine container 2.

8

Figure 21:
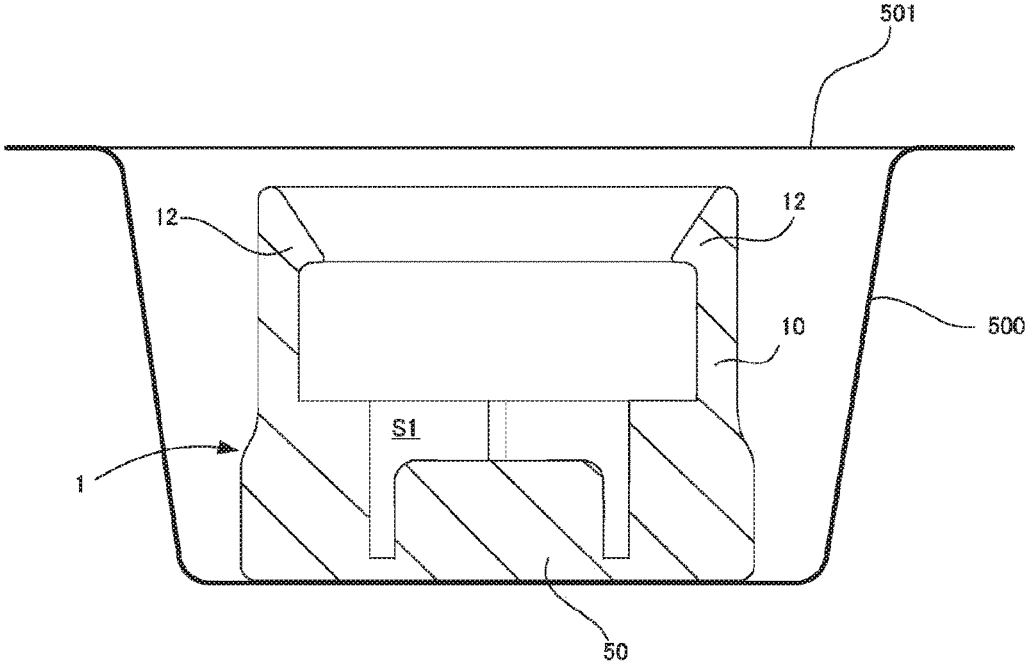
FIG. 21 is a side cross-sectional diagram showing the state where the lid cover in FIG. 11 is stored in a storage implement.

The lid cover 1 of the present invention can be sterilely packaged in a blister pack (storage implement) 500 in which a peelable film 501 is attached to the flange of an opening of an upper portion, for example. At this time, for example, if the lid cover 1 is stored such that the ceiling face portion 50 is directed downward as shown in FIG. 21, when the peelable film 501 of the blister pack 500 is removed when the lid cover 1 is used, the lid cover 1 is exposed in the state where the fastening portion 12 side of the lid cover 1 is directed upward. By inserting the bottle plug 22 of the medicine container 2 into this, the lid cover 1 can be mounted without being touched directly by a hand.

9

Water repellence processing can be performed on the internal face of the lid cover of the present invention as necessary. The means for this is not particularly limited as long as the means does not affect the medicine to be collected and does not reduce the sealability of the lid cover.

Working Example

A working example of the present invention will be described below. However, the present invention is not limited to the following working example. In the following description, lid covers according to the working example and a comparison example were manufactured, and three tests were performed.

1. Working Example

Figure 22A:
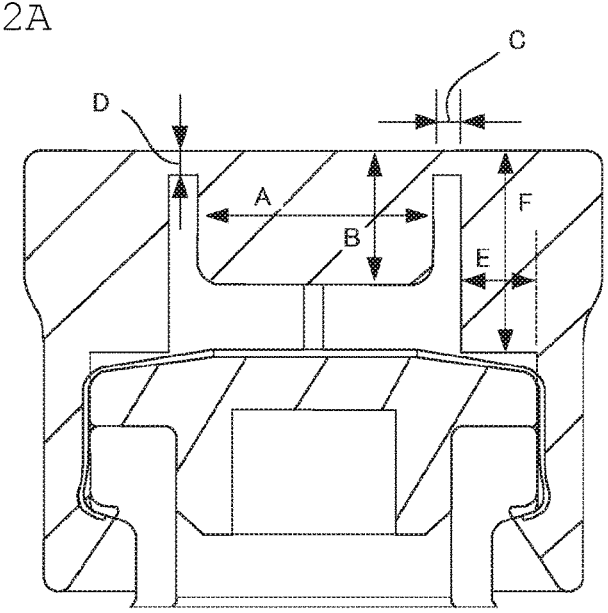
FIG. 22A is a side cross-sectional diagram showing a lid cover according to Working Example 1.
Figure 22B:
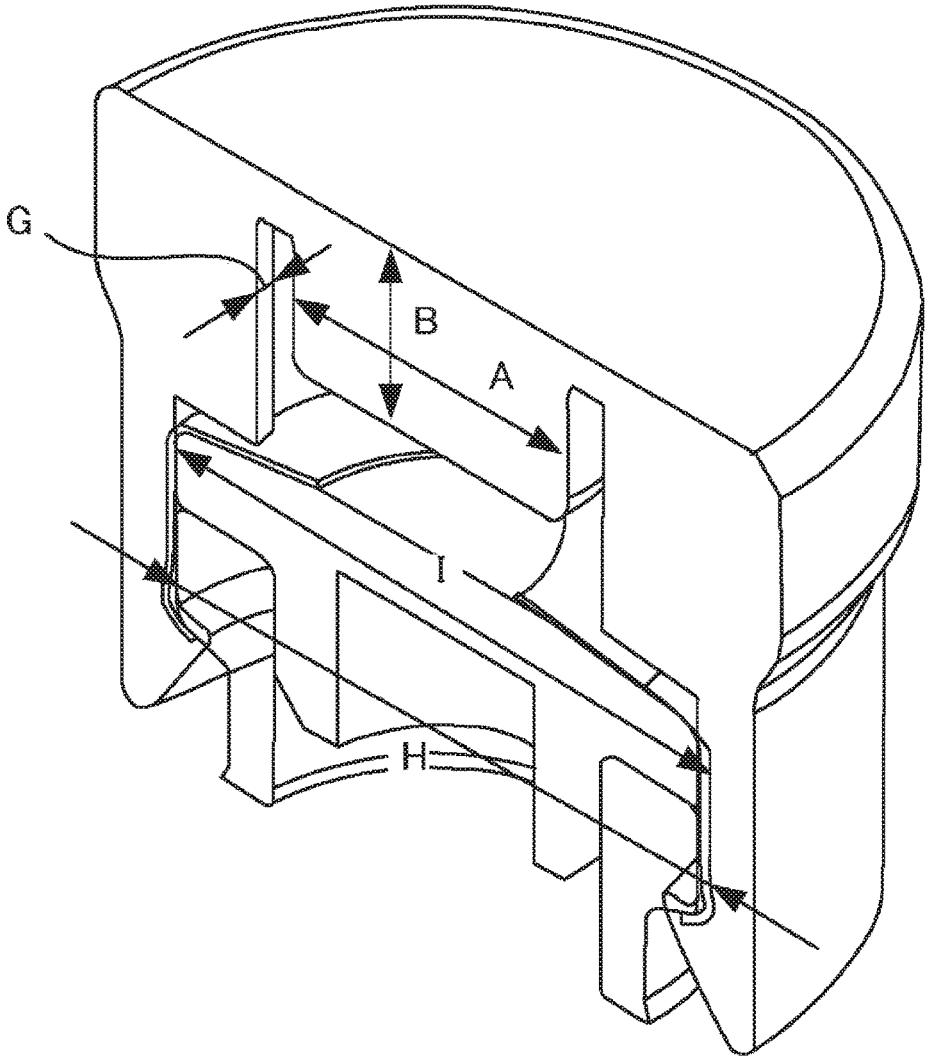
FIG. 22B is a perspective cross-sectional diagram showing the lid cover according to Working Example 1.

As a lid cover according to a working example, a lid cover that has the same configuration as the above-described lid cover 1 shown in FIG. 11 and has the dimensions shown in FIG. 22 was used. Specific numerical values of the dimensions are as follows.

External diameter A of central portion: 9 mm
Thickness B of central portion: 5 mm
Width C of outer periphery portion: 0.5 mm
Thickness D of outer periphery portion: 2 mm
Width E of rib: 3.5 mm
Height F of rib: 8.5 mm
Thickness G of rib: 5 mm
Internal diameter H of peripheral wall portion (initial state): 19 mm
External diameter I of bottle plug: 21 mm This lid cover was manufactured using a thermoplastic elastomer (Shore A hardness: 35) composed mainly of SEBS (styrene-ethylene-butylene-styrene block copolymer) by injection molding. Subsequently, as shown in FIG. 21, this lid cover was stored in a storage implement, and the opening was sealed with a peelable film.

2. Comparison Example

A comparison example that has the same form as the working example except that the outer periphery portion is not provided was manufactured by injection molding. Accordingly, in the comparison example, the outer periphery portion is not provided, and thus the entire side face of the central portion is coupled to the outer peripheral edge of the ceiling face portion. Subsequently, similarly to the working example, as shown in FIG. 21, the lid cover was stored in a storage implement, and the opening was sealed with a peelable film.

3. Test 1

Figure 23:
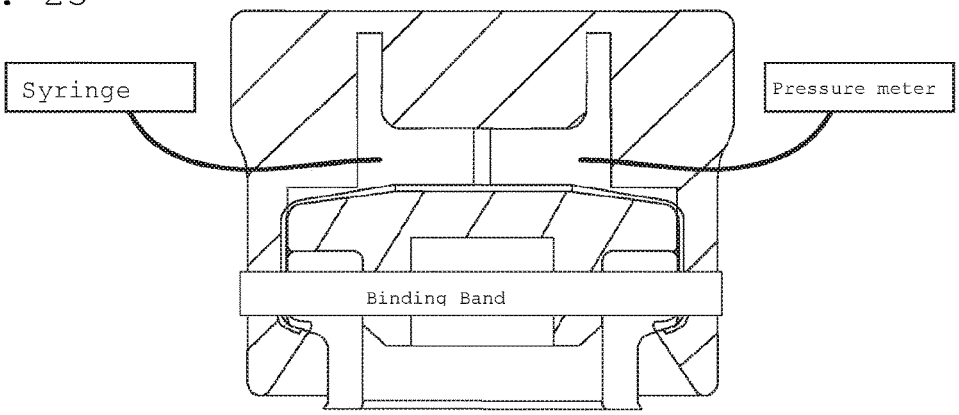
FIG. 23 is a diagram illustrating Test 1.

Regarding the working example in the state of FIG. 21, the peelable film was removed, and the lid portion of a medicine container (external diameter: 21 mm) was pressed in. Thereby, the bottle plug of the medicine container was mounted to the lid cover according to the working example. The pressure in the closed space at this time was approximately −1 KPa. Next, an 18 gauge injection needle (needle tip: short bevel) was pushed through the central portion of the mounted lid cover, and was then pulled out, and the pressure resistance of a portion pierced with the needle was measured as follows. Specifically, as shown in FIG. 23, a lower portion of the lid cover was tightened with a binding band, and the medicine container and the lid cover were sunk in water in the state where the peripheral wall portion was pierced with a needle of a syringe that contains air and the needle of a pressure meter. The air was then fed from the syringe into the closed space to pressurize the closed space, and the pressure when air bubbles started to come out from the portion pierced with the needle (needle hole) was measured using the pressure meter. As a result, no air bubble came out even when the closed space was pressurized to 100 KPa, which is the measurement upper limit of the pressure meter.

On the other hand, when a similar test was performed also on the comparison example, air bubbles started to leak to the outside in the state where the closed space was pressurized to 21.7 KPa (average: n=3).

4. Test 2

The following experiment was performed on the lid cover according to the above working example. Specifically, first, a medicine container that has a capacity of 10 ml, and stores 5 ml of red water was prepared, and the lid cover was mounted to the bottle plug of the medicine container. Next, an 18 gauge injection needle (needle tip: short bevel) was set in a 10 ml syringe, and the syringe was filled with 3 ml of air Subsequently, in the state where the medicine container is made upright, the lid cover and the bottle plug were pierced with the needle of the syringe in the stated order. The medicine container was then inverted in this state, the 3 ml of air in the syringe was transferred to the medicine container by a pumping operation, and 3 ml of red water in the medicine container was taken out into the syringe. After that, the plunger of the syringe was pressed in for 1 ml, and it took approximately 10 seconds until the plunger returned due to pressure difference. The plunger does not completely return due to friction, and the inside of the medicine container was slightly in a positive pressure state, and remaining liquid stayed. Subsequently, in this state, the needle was removed while the medicine container was inverted, and whether or not droplets fell to the outside of the lid cover at this time was visually observed. Also, filter paper was attached to the surface of the lid cover in order to determine whether or not liquid adhered to the surface of the lid cover, according to whether or not the attached filter paper was wet. When this experiment was performed 30 times, droplet falling was not observed (incidence: 0%), and liquid adherence to the lid cover surface was observed only in two examples (incidence: 7%).

On the other hand, as a result of performing a similar test on the comparison example as well, droplet falling was observed in one example out of 40 examples (incidence: 2.5%), and liquid adherence to the lid cover surface was observed in 26 examples out of 40 examples (incidence: 65%).

5. Test 3

3 mL of red water was put into a medicine container having a capacity of 10 ml with the rubber plug being removed, and the lid cover of the above working example was mounted. Next, the lid cover was pierced with an 18 gauge injection needle (needle tip: short bevel) without a needle hole, and air was further fed from the peripheral wall portion of the lid cover into the closed space using a syringe so as to pressurize the closed space to 30 KPa. After that, in the state where the medicine container is inverted, the injection needle was pulled out, liquid adhering to the surface of the lid cover was suctioned using a micro syringe, and was measured (n=3). Note that a tray was placed below the lid cover, and if a droplet fell on the tray when pulling out the injection needle, the droplet was also suctioned and measured. As a result, in the medicine container to which the lid cover of the working example was mounted, the amount of adhering liquid was always 1 μL or less. On the other hand, when a similar test was performed using the lid cover of the comparison example, the amount was 121 μL and 190 μL in two tests out of three, and 1.5 mL of liquid was jetted from the needle hole in the remaining one test.

6. Overview

From the above test results, the lid cover according to the working example of the present invention was found to have high airtightness for a needle hole. Specifically, it was found that the airtightness for the needle hole is high both when the lid cover is being pierced with a needle of a syringe, and after the needle was pulled out, and that there is almost no liquid leakage from the needle hole compared with the comparison example.

LIST OF REFERENCE NUMERALS

1 Lid cover
10 Peripheral wall portion
16 Rib (restriction member)
2 Medicine container
22 Bottle plug (lid portion)
22*a* Upper face of bottle plug (piercing face)
3 Syringe
33 Needle
50 Ceiling face portion
51 Central portion
52 Outer periphery portion
S1 Closed space

The invention claimed is:

1. A lid cover for a medicine container for preventing a medicine, which is air-tightly stored in the medicine container having a lid portion that can be pierced with a needle, from leaking to an outside space when the medicine is suctioned using a syringe having the needle, the lid cover comprising:

a peripheral wall portion that can be mounted to the lid portion so as to surround a piercing face of the lid portion that is pierced with the needle; and a ceiling face portion that is continuous with an upper portion of the peripheral wall portion, and can be pierced with the needle, wherein the peripheral wall portion and the ceiling face portion are made of an elastic material, and are configured to, in a state where the peripheral wall portion is mounted to the lid portion, air-tightly store the piercing face such that the piercing face is not exposed to the outside space, while also forming a closed space between the piercing face and the ceiling face portion, and the ceiling face portion has a central portion that opposes the piercing face, and is pierced with the needle, and an outer periphery portion that is formed in a periphery of the central portion, and is thinner than the central portion.

2. The lid cover for a medicine container according to claim 1, further comprising:

a restriction member that restricts contact of the lid portion with the ceiling face portion in order to form the closed space between the lid portion and the ceiling face portion.

3. The lid cover for a medicine container according to claim 2, wherein the restriction member is formed by a plurality of ribs that protrude from the ceiling face portion or the peripheral wall portion.

4. The lid cover for a medicine container according to claim 3, wherein the plurality of ribs are arranged at a predetermined interval along a peripheral direction of the peripheral wall portion.

5. The lid cover for a medicine container according to claim 1, wherein an upper face of the ceiling face portion is formed in a flat face shape or a curved face shape, and the central portion is formed so as to protrude from a lower face of the ceiling face portion.

6. The lid cover for a medicine container according to claim 1, wherein a ratio of a thickness of the central portion to a thickness of the outer periphery portion is 2 to 10.

7. The lid cover for a medicine container according to claim 1, wherein the outer periphery portion has a thickness of 0.5 to 3 mm and a width of 0.3 to 3 mm.

8. The lid cover for a medicine container according to claim 1, wherein Shore A hardness of the elastic material is 15 to 50.

9. The lid cover for a medicine container according to claim 1, wherein a recessed portion is formed in the upper face of the ceiling face portion.

10. The lid cover for a medicine container according to claim 9, wherein the recessed portion is formed in a curved face shape.

11. The lid cover for a medicine container according to claim 1, wherein pressure in the closed space is negative pressure of −5 KPa or more in a state where the peripheral wall portion is mounted to the lid portion of the medicine container.

12. The lid cover for a medicine container according to claim 1, wherein the outer periphery portion is inclined toward the central portion.

13. The lid cover according to claim 12, further comprising:

in the upper portion, a restriction member that restricts contact of the lid portion with the ceiling face portion in order to form the closed space between the lid portion and the ceiling face portion.

* * * * *